US008622166B1

(12) United States Patent
Torres-Muniz et al.

(10) Patent No.: US 8,622,166 B1
(45) Date of Patent: Jan. 7, 2014

(54) SWITCH-ACTUATED JOYSTICK FOR POWER WHEELCHAIRS

(75) Inventors: Raul Edmir Torres-Muniz, Anasco, PR (US); Sergio E. Garcia-Vegara, Humacao, PR (US); Baldin Lorens-Bonilla, San German, PR (US); Daphne Sanchez-Cordero, Moca, PR (US); Mauricio Lizama, San Juan, PR (US)

(73) Assignee: University of Puerto Rico, San Juan, PR (US)

( * ) Notice: Subject to any disclaimer, the term of this patent is extended or adjusted under 35 U.S.C. 154(b) by 0 days.

(21) Appl. No.: 13/599,519

(22) Filed: Aug. 30, 2012

(51) Int. Cl.
*A61G 5/04* (2013.01)
*A61G 5/10* (2006.01)

(52) U.S. Cl.
USPC ..... 180/316; 700/302; 701/41; 74/471 XY; 180/907; 180/218

(58) Field of Classification Search
USPC ..... 180/316, 218, 907, 65.1; 700/302; 701/41; 74/471 XY; 280/771
IPC ..... A61G 5/04,5/10
See application file for complete search history.

(56) References Cited

U.S. PATENT DOCUMENTS

| | | | | |
|---|---|---|---|---|
| 3,394,611 | A * | 7/1968 | Beurrier | 74/471 R |
| 4,078,627 | A * | 3/1978 | Brown et al. | 180/6.5 |
| 4,587,510 | A * | 5/1986 | Kim | 338/128 |
| 8,340,869 | B2 * | 12/2012 | Wakita et al. | 701/41 |
| 8,371,187 | B2 * | 2/2013 | Payandeh et al. | 74/471 XY |
| 2013/0018524 | A1 * | 1/2013 | Ankers et al. | 701/1 |

* cited by examiner

*Primary Examiner* — Ruth Ilan
(74) *Attorney, Agent, or Firm* — Hoglund & Pamias, PSC; Roberto J. Rios

(57) ABSTRACT

The present invention provides a universal single switch driving system for power wheelchairs, which can be attached to any wheelchair joystick and remotely controlled, by any single switch available for persons with disabilities.

19 Claims, 6 Drawing Sheets

SWITCH-ACTUATED JOYSTICK FOR POWER WHEELCHAIRS

BACKGROUND OF THE INVENTION

Persons with severe physical disabilities require the use of power wheelchairs for mobility, which are typically controlled through a joystick. However, when the user has no functional control of his/her upper extremities (e.g. quadriplegia) using a joystick becomes inadequate. In these cases the use of alternate control systems is needed such as head arrays, chin joysticks, foot control, etc. Several progressive conditions such as multiple sclerosis (MS) and amio-lateral sclerosis (ALS) often render these alternate systems unusable since voluntary motor control becomes extremely limited. For such severe cases a single switch-driving system (e.g. blink switch, puff switch, EMG switch) is used to control a scanning array linked to the wheelchair electronics. These switch-driving systems require the use of specialized control interfaces, special wheelchair electronics and special rehab wheelchairs all of which are very expensive and limit the use of switch driving control to a very limited number of high end wheelchairs. For individuals with severe progressive conditions, such as the ones indicated before, this means being able to drive their wheelchairs with a regular joystick at one point in time and then having to abandon the chair they are used to, in order to acquire a new chair (which may easily cost three to four times as much as their original chair) so that the needed electronics and driving interfaces can be purchased and incorporated to it.

Thus, what is needed is a universal single actuator-driving system for power wheelchairs, which can be attached to any wheelchair joystick and controlled by any of the single switches available for persons with disabilities.

SUMMARY OF THE INVENTION

According to an aspect of the invention, a remote joystick actuating apparatus includes a first moving element having a first pass-through opening receiving said joystick, wherein a portion of said first moving element is mechanically connected to a first movement generating unit, said first moving element moves said joystick between a front and back position in response to said first movement generating unit activation.

According to another aspect of the invention, a second moving element having a second pass-through opening receiving said joystick is provided, wherein a portion of said second moving element is mechanically connected to a second movement generating unit, said second moving element moves said joystick between a left and right position in response to said second movement generating unit activation.

According to a further aspect of the invention, a control unit is provided that selectively activates said first and second movement generating units to remotely move said joystick in a plurality of directions based on user-generated input signals.

In accordance to one aspect of the invention, user-generated input signals are generated by switch means operated by a user, said switch means being remotely located from said first and second moving elements.

According to another aspect of the invention, a direction-indicating element connected to said control unit is provided for indicating a user said plurality of directions.

According to still another aspect of the invention, the direction-indicating element comprises a plurality of visual indicators oriented in a circular arrangement, each of said plurality of visual indicators representing a different direction.

According to a further aspect of the invention, the control unit receives a first user generated input signal generated by a user operating said switch means and sequentially activates each of said plurality of visual indicators each representing a different direction.

According to an aspect of the invention, each of said plurality of visual indicators remains activate for a predetermined amount of time when activated.

According to another aspect of the invention, said plurality of visual indicators is activated in clockwise manner.

According to a further aspect of the invention, the control unit further receives a second user generated input signal generated by a user operating said switch means to select a desired direction corresponding to an active visual indicator, said control unit selectively activates said first and second movement generating units to remotely move said joystick in a direction corresponding to said active visual indicator.

According to one aspect of the invention, the active visual indicator will remain active and said first and second movement generating units will hold said joystick in said direction corresponding to said active visual indicator as long as the user maintains said switch means operated to generate said second user generated input signal.

According to another aspect of the invention, a user release of said switch means interrupts the generation of said second user generated input signal, said control unit selectively controlling said first and second movement generating units to remotely move said joystick to a neutral position in response to said second user generated input signal interruption.

According to still another aspect of the invention, the active visual indicator is further deactivated in response to said switch means being released by the user and said second user generated input signal being interrupted, said control unit sequentially activates each of said plurality of visual indicators each representing a different direction for the user to select.

In accordance to another aspect of the invention, the control unit enters an idle state after said plurality of visual indicators have been activated a predetermined amount of times without said switch means being operated.

According to an aspect of the invention, each of said first and second movement generating units comprises a bidirectional motor.

According to another aspect of the invention, each of said first and second moving elements comprises a semicircular rail having a middle pass-through opening, said first and second moving elements being positioned one on top of the other so that said joystick passes through the middle pass-through openings of both semicircular rails.

According to still another aspect of the invention, the switch means comprises a first switch and a second switch, said control unit receives a first user generated input signal generated by a user operating said first switch and sequentially activating each of said plurality of visual indicators each representing a different direction.

According to a further aspect of the invention, the control unit receives a second user generated input signal generated by a user operating said second switch to select a desired direction corresponding to an active visual indicator, said control unit selectively activating said first and second movement generating units to remotely move said joystick in a direction corresponding to said active visual indicator.

According to one aspect of the invention, an audible element connected to said control unit for indicating a user which each of said plurality of visual indicators is active.

According to another aspect of the invention, the joystick actuating apparatus is coupled to a powered wheelchair joystick.

According to still another aspect of the invention, the powered wheelchair joystick is removed from an armrest area of said wheelchair and both said joystick actuating apparatus coupled to said powered wheelchair joystick are positioned in another part of the wheelchair.

BRIEF DESCRIPTION OF THE DRAWINGS

Further features and advantages of the invention will become apparent from the following detailed description taken in conjunction with the accompanying figures showing illustrative embodiments of the invention, in which.

Throughout the figures, the same reference numbers and characters, unless otherwise stated, are used to denote like elements, components, portions or features of the illustrated embodiments. The subject invention will be described in detail in conjunction with the accompanying figures, in view of the illustrative embodiments.

DETAILED DESCRIPTION OF THE INVENTION

The present invention provides a universal single switch driving system for power wheelchairs which can be attached to any wheelchair joystick and controlled by any of the single switches available for persons with disabilities.

As shown in FIGS. 1-6, the system is composed of two main parts: a) a controlling unit 8 where the user plugs any single switch 7 to scan through an LED array (or similar display) 6 in order to select the desired function, and b) an actuator unit 1 which physically moves the joystick 2 based on the user's selection. This actuator unit is fitted over the wheelchair joystick and is adjusted to the joystick support arm or wheelchair armrest. The LED array is mounted on a gooseneck or other adjustable support structure for easy viewing and fitted to the side of the chair.

Users with severe physical disabilities have a wide selection of single switches (also called capability switches) available to them according to their functional capabilities (e.g. puff switch, blink switch, EMG switch). These switches allow a user to control any switch-adapted device such as a computer, electronic aids to daily living, communication systems, etc. Any of the single switches available on the market can be plugged into the controlling unit of the proposed invention to serve as the user interface according to the functional capabilities of the individual.

Figure 3:
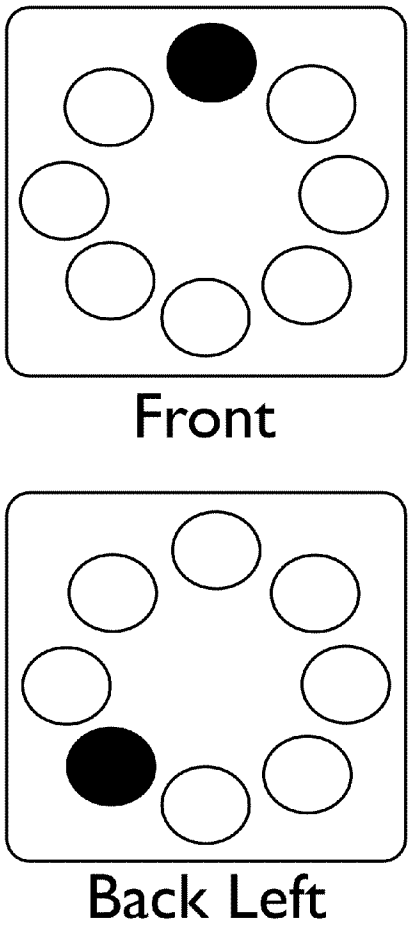
FIG. 3 shows direction indicating arrangement according to the present invention.
Figure 5:
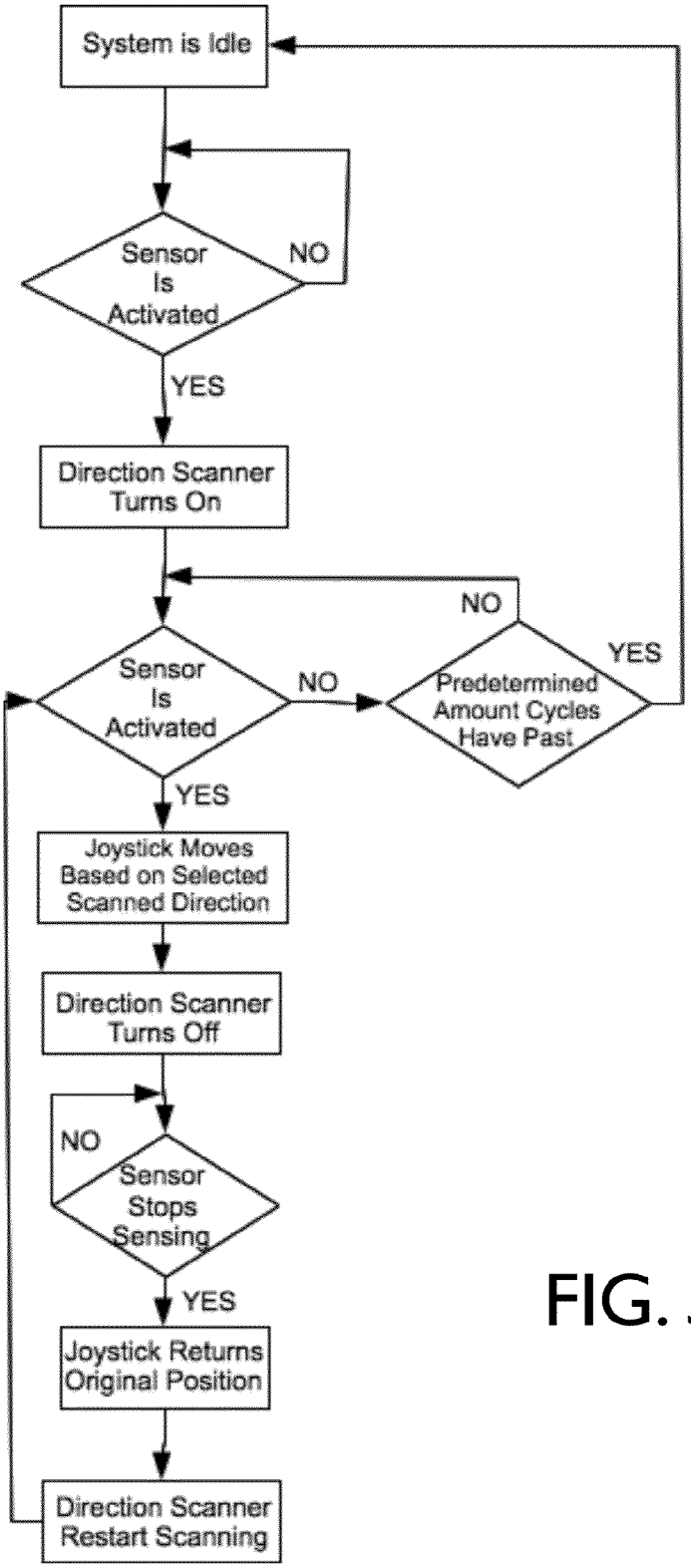
FIG. 5 shows a flowchart of the operation of the switch-actuated joystick system according to the present invention.

As explained in FIG. 5, when the user activates the single switch 7 a microcontroller (or similar electronic device) located inside the controlling unit 8 receives the input and activates a direction indicator 6 consisting of eight small LEDs 6*a* distributed in a circular configuration that geometrically represent the eight cardinal points, or any similar display as shown in FIG. 3. Each cardinal-point indicator lights up one at a time (clockwise) at a predetermined speed that can be adjusted according the user visual-motor coordination. When the user sees the desired cardinal-point indicator light up (e.g. left) he/she activates the switch 7 to select the function and the signal is sent to the microcontroller for it to turn on the actuator 1 that physically moves the joystick 2 in the desired direction. As long as the single switch 2 remains activated, the selected directional indicator 6*a* will remain lit up and the corresponding actuator 4*a*, 4*b* will "hold" the joystick 2 in the desired direction until the user releases the switch 7. When the user releases the switch 7, the selected cardinal-point indicator 6*a* turns off and so does the corresponding actuator 4*a*, 4*b*, thus allowing the joystick 2 to return to the neutral (middle) position. The cardinal-point indicator 6, then, resumes the scanning for the user, to select the next direction to move.

As a power saving feature, the directional indicators will cycle a predetermined number of times (adjustable in the programming) and then turn off if the user does not make a selection, thus remaining in an idle state. Activating the switch 7 once again will activate the cardinal-points display 6 and resume scanning. The scanning system also includes a sound option (that can be toggled on/off) to provide auditory feedback (beeps) while the cardinal-point indicator cycle through the directions.

Figure 4:
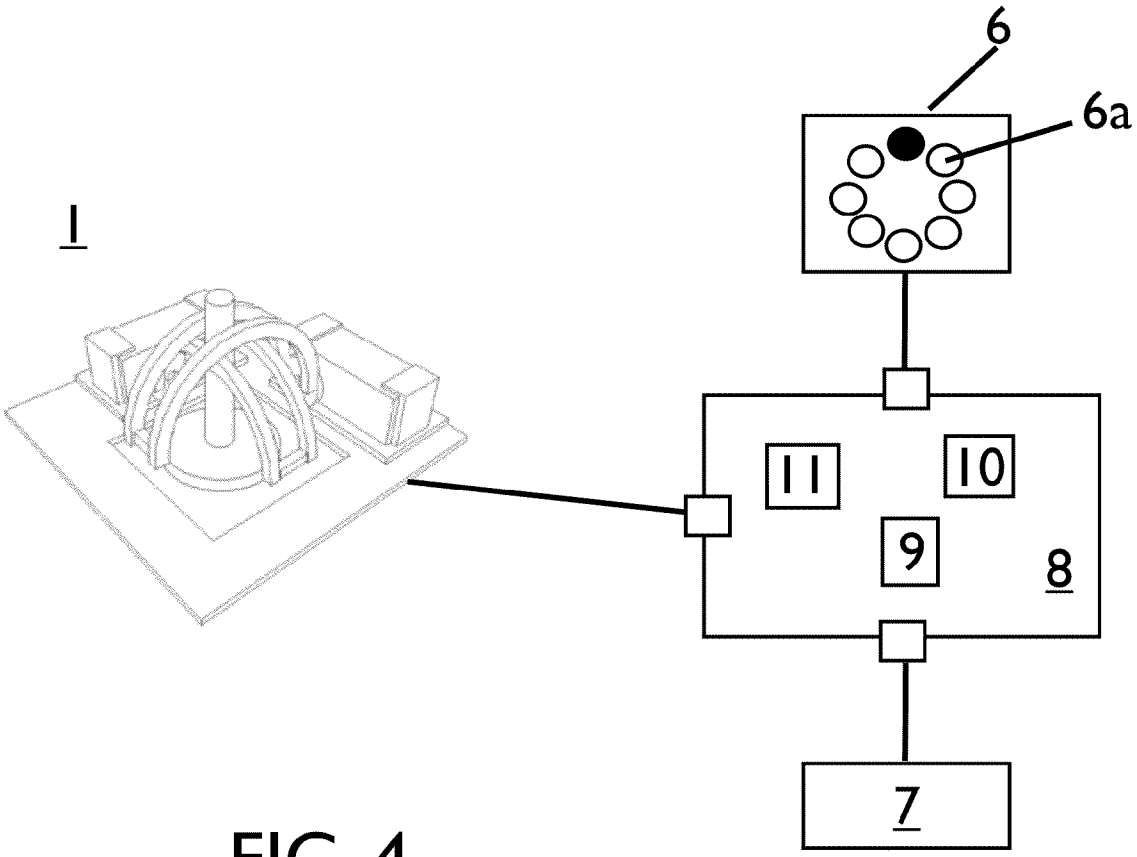
FIG. 4 shows a switch-actuated joystick system according to the present invention.
Figure 6:
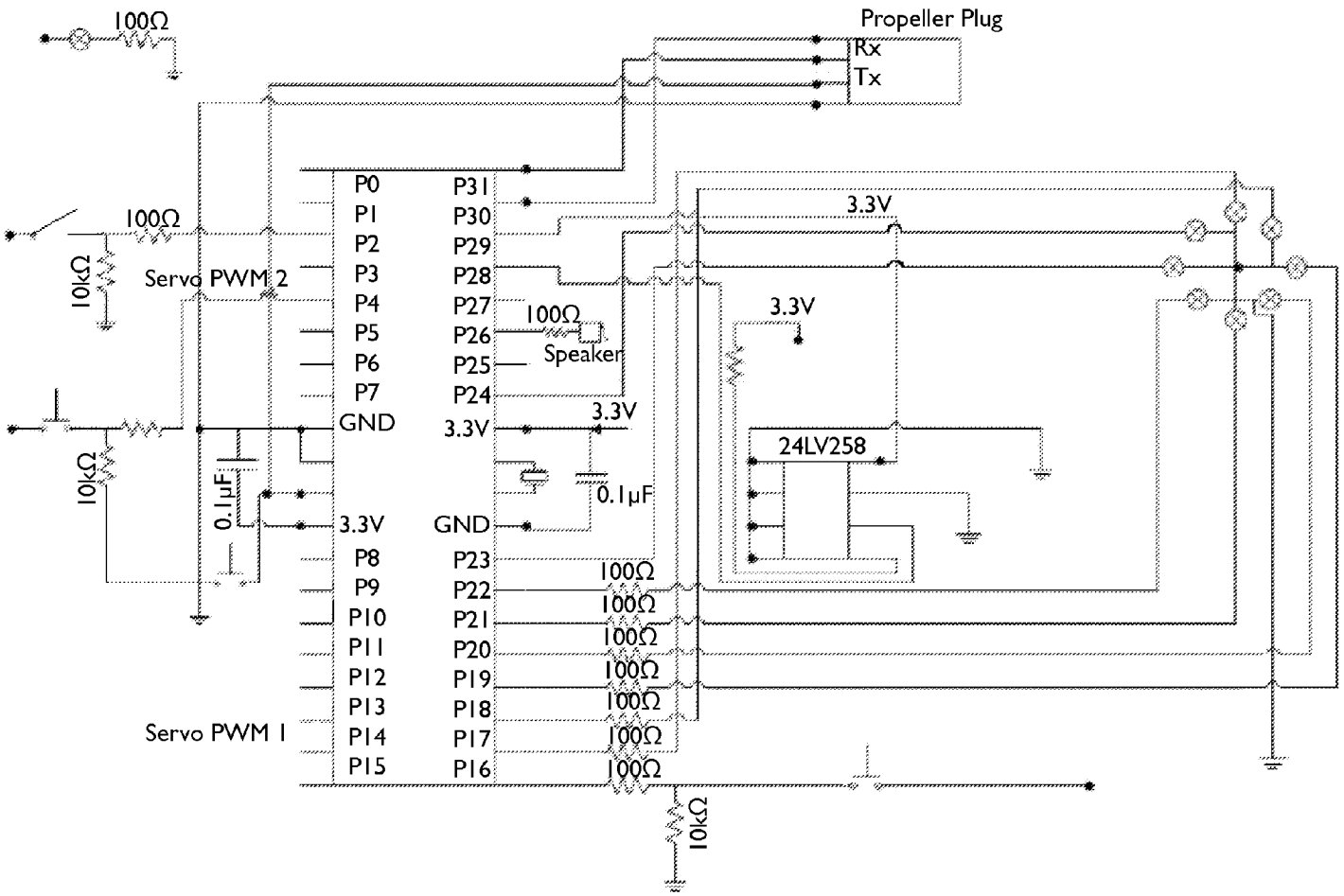
FIG. 6 shows an electric schematic of the switch-actuated joystick system according to the present invention.

FIG. 4 and FIG. 6 show a switch-actuated joystick system and electrical schematic according to the present invention. The controlling unit 8 comprises a scanning circuit 9 configured to scan and detect a user-generated from the switch 7. A cardinal-points display 6 having a plurality of directional indicators 6*a* receives an activating signal from a driving circuit 10 on said controlling unit 8. Once a desired direction is determined according to the present invention, a motor driving circuit 11 sends a driving signal to selectively control motors 3*a*, 3*b* so that the joystick 2 is moved to a direction corresponding to a selected direction as represented by a selected active directional indicators 6*a*.

Figure 1:
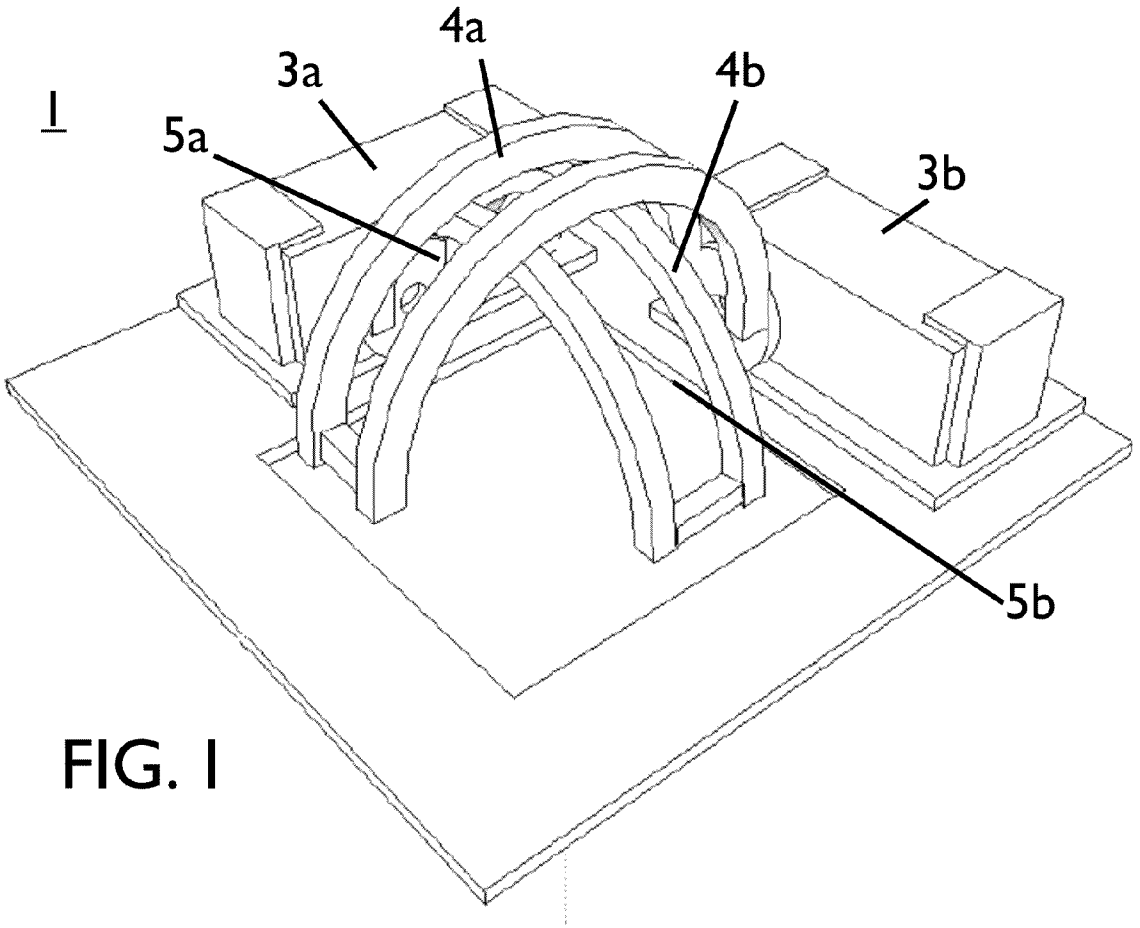
FIG. 1 shows a joystick adapter according to the present invention.
Figure 2:
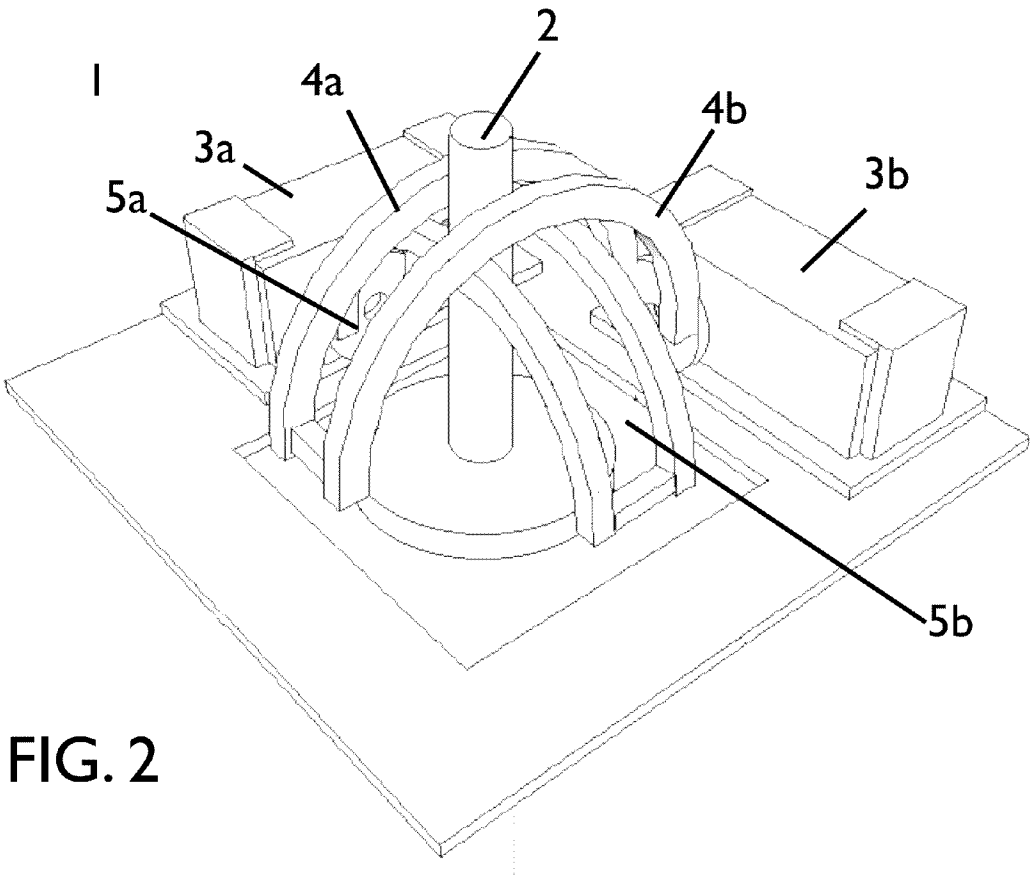
FIG. 2 shows a joystick adapter used in conjunction with a joystick according to the present invention.

As shown in FIG. 1 and FIG. 2, the actuator system 1 consists of two motors 3*a*, 3*b* placed in a perpendicular arrangement along the horizontal plane. A semicircular rail 4*a*, 4*b* is attached to the rotating part each motor 3*a*, 3*b*. Each rail 4*a*, 4*b* has an internal separation 5*a*, 5*b* large enough for the joystick to fit (the separation between the rails can be adjustable with a screw in order for this system to be adaptable to different joystick sizes). As seen in the Figures, the two motors 3*a*, 3*b* and their corresponding rails 4*a*, 4*b* work perpendicularly to each other so that one of them can move the joystick 2 left/right and the other can move it forward/backward. The two rails 4*a*, 4*b* are concentric to each other so that the joystick 2 can assume all eight positions (e.g. front, front-right, back-left, etc) without one rail colliding with the other. According to the directional indicator 6*a* selected by the user in the controlling unit, the microcontroller (or similar electronic device) activates one motor at a time for basic movements (e.g. left, forward) or both motors at the same time for combination movements (e.g. forward/right). The motors in the actuator system 1 then physically move the joystick 2 in the desired direction until the controlling unit 8 receives another signal.

The whole system is powered through the wheelchair batteries (24V). Voltage regulators can be used to bring the voltage from 24V to 12V. Then two more are used, one to go from 12V to 5V, which are supplied as the operating voltage for the motors. The other one is used for 12V to 3.3V to power the microcontroller (or similar electronic device). These voltage regulators were used specifically for the prototype, but a DC-to-DC converter (buck configuration) would be used in the actual product so as to reduce the amount of energy that is lost with the regulators.

According to another embodiment, a double switch step-scanning system can be used instead of the single switch auto-scanning. One switch would be used to scan through the choices and the other one would select the desired one.

The joystick and joystick control assembly may be taken off the arm rest area and mounted in another part of the wheelchair (e.g. back of the chair, under the chair) since the user will not directly control the joystick. This will free up space that could be needed for wheelchair trays, mounting of augmentative and alternative communication (AAC) devices or to facilitate patient transfers to and from the wheelchair.

The LED array of the preferred embodiment can be substituted by a backlit liquid crystal display, which can present the user with the scanned choices. Beeping in the auditory scanning mode may be substituted by a synthesized or digitized voice cue to indicate the choices being scanned. Scanning options and corresponding actuators may be added to control special wheelchair functions such as power recline, power leg raise, tilt in space, etc. Voltage regulators can be replaced by a DC-to-DC converter (buck configuration) so as to reduce the amount of energy that is lost with the regulators. The servomotors may be substituted by step motors, solenoids or the like.

Although the present invention has been described herein with reference to the foregoing exemplary embodiment, this embodiment does not serve to limit the scope of the present invention. Accordingly, those skilled in the art to which the present invention pertains will appreciate that various modifications are possible, without departing from the technical spirit of the present invention.

We claim:

1. A remote joystick actuating apparatus comprising:

a first moving element having a first pass-through opening receiving said joystick, wherein a portion of said first moving element is mechanically connected to a first movement generating unit, said first moving element moves said joystick between a front and back position in response to said first movement generating unit activation;

a second moving element having a second pass-through opening receiving said joystick, wherein a portion of said second moving element is mechanically connected to a second movement generating unit, said second moving element moves said joystick between a left and right position in response to said second movement generating unit activation; and a control unit selectively activating said first and second movement generating units to remotely move said joystick in a plurality of directions based on user-generated input signals.

2. The remote joystick actuating apparatus of claim 1, wherein said user-generated input signals are generated by switch means operated by a user, said switch means being remotely located from said first and second moving elements.

3. The remote joystick actuating apparatus of claim 2, further comprising a direction-indicating element connected to said control unit for indicating a user said plurality of directions.

4. The remote joystick actuating apparatus of claim 3, wherein said direction-indicating element comprises a plurality of visual indicators oriented in a circular arrangement, each of said plurality of visual indicators representing a different direction.

5. The remote joystick actuating apparatus of claim 4, wherein said control unit receives a first user generated input signal generated by a user operating said switch means and sequentially activates each of said plurality of visual indicators each representing a different direction.

6. The remote joystick actuating apparatus of claim 5, wherein each of said plurality of visual indicators remains activate for a predetermined amount of time when activated.

7. The remote joystick actuating apparatus of claim 5, wherein said plurality of visual indicators is activated in clockwise manner.

8. The remote joystick actuating apparatus of claim 5, wherein said control unit further receives a second user generated input signal generated by a user operating said switch means to select a desired direction corresponding to an active visual indicator, said control unit selectively activates said first and second movement generating units to remotely move said joystick in a direction corresponding to said active visual indicator.

9. The remote joystick actuating apparatus of claim 8, wherein said active visual indicator will remain active and said first and second movement generating units will hold said joystick in said direction corresponding to said active visual indicator as long as the user maintains said switch means operated to generate said second user generated input signal.

10. The remote joystick actuating apparatus of claim 9, wherein a user release of said switch means interrupts the generation of said second user generated input signal, said control unit selectively controlling said first and second movement generating units to remotely move said joystick to a neutral position in response to said second user generated input signal interruption.

11. The remote joystick actuating apparatus of claim 10, wherein said active visual indicator is further deactivated in response to said switch means being released by the user and said second user generated input signal being interrupted, said control unit sequentially activates each of said plurality of visual indicators each representing a different direction for the user to select.

12. The remote joystick actuating apparatus of claim 11, wherein the control unit enters an idle state after said plurality of visual indicators have been activated a predetermined amount of times without said switch means being operated.

13. The remote joystick actuating apparatus of claim 1, wherein each of said first and second movement generating units comprises a bidirectional motor.

14. The remote joystick actuating apparatus of claim 1, wherein each of said first and second moving elements comprises a semicircular rail having a middle pass-through opening, said first and second moving elements being positioned one on top of the other so that said joystick passes through the middle pass-through openings of both semicircular rails.

15. The remote joystick actuating apparatus of claim 4, wherein said switch means comprises a first switch and a second switch, said control unit receives a first user generated input signal generated by a user operating said first switch and sequentially activating each of said plurality of visual indicators each representing a different direction.

16. The remote joystick actuating apparatus of claim 15, wherein said control unit receives a second user generated input signal generated by a user operating said second switch to select a desired direction corresponding to an active visual indicator, said control unit selectively activating said first and second movement generating units to remotely move said joystick in a direction corresponding to said active visual indicator.

17. The remote joystick actuating apparatus of claim 5, further comprising an audible element connected to said control unit for indicating a user which each of said plurality of visual indicators is active.

18. The remote joystick actuating apparatus of claim 1, wherein said joystick actuating apparatus is coupled to a powered wheelchair joystick.

19. The remote joystick actuating apparatus of claim 18, wherein said powered wheelchair joystick is removed from an armrest area of said wheelchair and both said joystick actuating apparatus coupled to said powered wheelchair joystick are positioned in another part of the wheelchair.

* * * * *